United States Patent [19]

Stampfli

[11] 4,114,184

[45] Sep. 12, 1978

[54] CONTROL SYSTEM FOR AN ELECTROMAGNET

[75] Inventor: Harald Stampfli, Geneva, Switzerland

[73] Assignee: Lucifer S.A., Geneva, Switzerland

[21] Appl. No.: 718,545

[22] Filed: Aug. 30, 1976

[30] Foreign Application Priority Data

Sep. 5, 1975 [CH] Switzerland ..... 11569/75

[51] Int. Cl.[2] ..... H01H 47/04; H01H 47/32

[52] U.S. Cl. ..... 361/154; 361/194; 361/210

[58] Field of Search ..... 361/152, 154, 194, 197, 361/210

[56] References Cited

U.S. PATENT DOCUMENTS

| | | | |
|---|---|---|---|
| 3,456,164 | 7/1969 | Sternberg | 361/194 |
| 3,660,730 | 5/1972 | Mason | 361/152 |
| 3,689,808 | 9/1972 | Stampfli | 361/194 |
| 3,737,736 | 6/1973 | Stampfli | 361/197 |
| 3,786,314 | 1/1974 | Misch | 361/194 |
| 3,852,646 | 12/1974 | Mason | 361/154 |

*Primary Examiner*—Gerald Goldberg
*Attorney, Agent, or Firm*—Emory L. Groff, Jr.

[57] ABSTRACT

Control system for an electromagnet having a movable core, wherein a power winding is provided for moving the core to active position and a holding winding requiring less power maintains the core in active position. A transistor controls the power supply circuit and, when made conductive, energizes a transistor in series with each winding, thus energizing both windings. After a time delay provided by a resistor-condenser circuit, another transistor is energized which causes the transistor in the power winding to become non-conductive, thus de-energizing the power winding. De-energizing the control transistor causes the transistor in the maintenance winding to become non-conductive so that the maintenance winding is de-energized and its energy is dissipated through a Zener diode and a resistor, both in series therewith.

3 Claims, 1 Drawing Figure

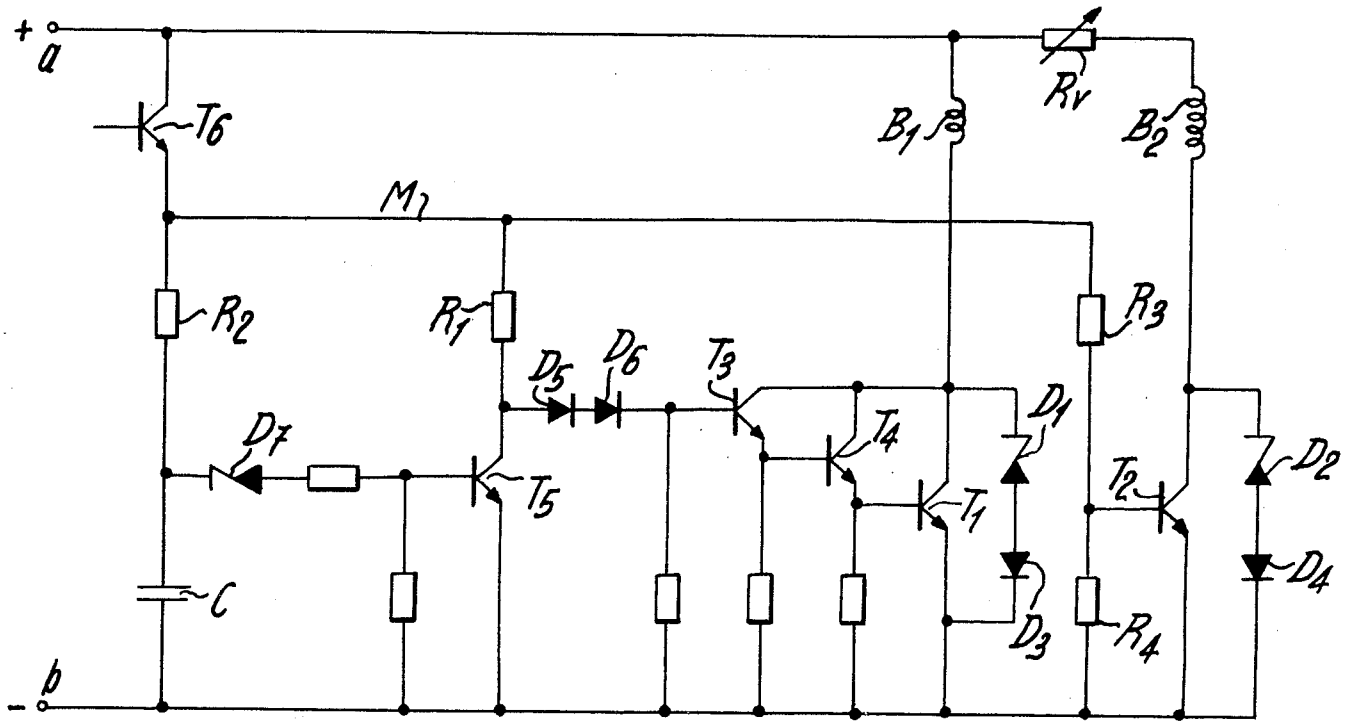
D2
D4
B2
R3
T2
R4
Rv
D1
D3
B1
T1
T4
T3
D6
D5
T5
R1
M1
D7
T6
R2
C
+ a
b -

CONTROL SYSTEM FOR AN ELECTROMAGNET

There are known systems for controlling electromagnets which, when energized, supply a high initial current, followed by a smaller maintenance current, consisting of a first semiconductor whose conductivity can be controlled intended to control the initial current and a second semiconductor with controllable conductivity intended to control the maintenance current.

The systems of this type that are known are often used to control a device in an installation automatically or servomechanically. When these systems are fed by alternating current, it is easy to control them by means of a thyristor which controls the supply current. Another thyristor may be provided, for example, to automatically cut off the initial current to the electromagnet at a given time after its application. Control systems of this type are described, for example, in U.S. Pat. Nos. 3,689,808 and 3,737,736.

When a system of this type is to be fed from a source of direct current, it is no longer possible to employ thyristors and the supply current must be controlled by a transistor that can withstand the high initial current which is generally quite high. It is therefore necessary to provide a power transistor which is relatively expensive and delicate.

This invention relates to a control system of the type mentioned above in which it is possible to eliminate this power transistor for activating the system. For this purpose, the system of this invention is characterized by the fact that it contains a control circuit that is common to two semiconductors and to components for applying to this circuit a control voltage which simultaneously renders the two semiconductors conductive and a delaying device acting on the first semiconductor to eliminate its control voltage at a predetermined time after its application.

The single FIGURE of the attached drawing shows the diagram of a preferred embodiment of the control system constituting this invention.

The circuit shown includes two supply terminals *a* and *b* intended to be connected to a source of direct current. Terminal *a* is connected to one end of winding $B_1$ of an electromagnet, this winding being intended to carry a high initial current. The electromagnet includes a second winding $B_2$ that is connected to terminal *a* by a variable resistor $R_v$ and is intended to carry the maintenance current, which is lower than the initial current since it is only needed to maintain the electromagnet in its actuated position.

Windings $B_1$ and $B_2$ are respectively connected in series with transistors $T_1$ and $T_2$. These transistors permit connecting the other ends of the windings to terminal *b*. Each of these transistors, $T_1$ and $T_2$, has its collector connected to its emitter by a Zener diode ($D_1$ or $D_2$) which is connected in series with a conventional diode $D_3$ or $D_4$.

Transistor $T_1$ is controlled by an amplifier containing two cascaded transistors $T_3$ and $T_4$ as well as two diodes $D_5$ and $D_6$ in series with its input. The input to this amplifier may be connected to the potential of terminal *b* by a transistor $T_5$ when it is conducting or to the potential of terminal *a* by a resistor $R_1$ and a transistor $T_6$.

The transistor $T_6$ is intended to control the activation and deactivation of the system. It may be made conductive by applying an appropriate voltage to its base.

Since its base current is very small, the control voltage applied to $T_6$ consumes a negligible amount of energy so that it is easy and inexpensive to provide a well-regulated and well-filtered voltage supply that will permit very precise energizing of transistor $T_6$. When the latter is conductive, the potential of terminal *a* is applied to a condenser C through a resistor $R_2$ so that the condenser is gradually charged. As soon as the voltage of the latter exceeds the critical voltage of a Zener diode $D_7$, a positive potential is applied to the base of the transistor $T_5$ which becomes conductive. Consequently, the signal at the input to the control amplifier for transistor $T_1$ becomes practically zero and the transistor $T_1$ becomes non-conductive, thus cutting off the current that passes through winding $B_1$.

Conductive transistor $T_6$ permits applying the potential of terminal *a* to a line M which contains a voltage divider that is formed by resistors $R_3$ and $R_4$ and which furnishes transistor $T_2$ with a control signal that makes it conductive. When actuation of the electromagnet is desired, transistor $T_6$ is made conductive which also makes transistors $T_1$ and $T_2$ conductive. In fact, at the instant of energizing, transistor $T_5$ is not conductive so that the potential of terminal *a* is transmitted through resistor $R_1$ to the amplifier input and renders transistor $T_3$, $T_4$ and $T_1$ conductive. As soon as the condenser has been charged to a sufficiently high voltage, it makes the transistor $T_5$ conductive which returns transistors $T_3$, $T_4$ and $T_1$ to the non-conductive state. Consequently, the high initial current of the electromagnet runs through winding $B_1$ for only a relatively short predetermined time.

When it is desired to deenergize the electromagnet, transistor $T_6$ is made non-conductive, which cuts off the voltage from terminal *a* to line M. The voltage on line M is then determined by the voltage on the condenser C and by a voltage divider, one leg of which is formed by resistor $R_2$ and the other leg by resistors $R_3$ and $R_4$ in series. The potential at the base of transistor $T_2$ is also determined by the voltage on condenser C and by a voltage divider that contains resistors $R_2$ and $R_3$ in series in the input leg and resistor $R_4$ in the output leg. The resistance value of $R_2$ is sufficiently high with respect to that of resistors $R_3$ and $R_4$ so that the deenergizing caused by returning transistor $T_6$ to the non-conductive state causes the voltage on the base of transistor $T_2$ to fall to a level that is low enough to ensure that transistor $T_2$ becomes non-conductive. Thus, a very rapid manner of interrupting the maintenance current of the electromagnet is provided, which is quite advantageous in all cases where a rapid reaction of the system must be obtained. The drop in current through winding $B_2$ is rapid due to the presence of the Zener diode $D_2$ which rapidly dissipates the energy that is returned by winding $B_2$ at the instant that the current is cut off. This energy is also partially dissipated by resistor $R_v$.

As is known, the value of critical voltage of the Zener diode $D_2$ must be selected by taking into account the resistance of the circuit and the self-inductance of winding $B_2$ so as to cut off the excitation current running through winding $B_2$ in the shortest possible time.

In the case where transistor $T_6$ becomes non-conductive before the delay device, consisting of condenser C, has produced a state of non-conductivity in transistor $T_1$, it can be seen that the drop in voltage on line M also controls the stoppage of current passing through transistor $T_1$.

The system that has been described above is very advantageous since it may be driven by a very low powered control. Furthermore, during a storage commanded by normal conditions, that is, when only the current in winding $B_2$ is flowing, cutting off of current is controlled by transistor $T_2$ whose power consumption is relatively low.

Of course, many modifications may be made to the circuit which has been described. In particular, it could be adapted to the case of control of an electromagnet having only one winding. This adaptation could consist of eliminating winding $B_2$ in the drawing and connecting the collectors of transistors $T_1$ and $T_2$ by a resistor that will limit the current as soon as transistor $T_1$ becomes non-conductive.

Transistor $T_6$ could, of course, be replaced by a mechanical contact.

I claim:

1. Control system for an electromagnet for furnishing a high initial current upon energizing, followed by a smaller maintenance current, containing a first semiconductor ($T_1$), whose conductivity is controllable, connected in a first circuit adapted to control the initial current, and a second semiconductor ($T_2$), whose conductivity is controllable, connected in a second circuit adapted to control the maintenance current, a control circuit (M, $R_1$, $D_5$, $D_6$, $T_3$, $T_4$) common to the two semiconductors, switching means ($T_6$) for applying to the control circuit a control voltage that will simultaneously render the two semiconductors ($T_1$, $T_2$) conductive, a power line for supplying current to the electromagnet adapted to be connected through said switching means to said control circuit, and a delay device ($R_2$, C, $D_7$, $T_5$) acting on the first semiconductor so as to eliminate its control voltage at a predetermined time after its application, said delay device including a resistor ($R_2$) directly connected to said switching means and to a condenser (C) connected to said resistor, a Zender diode ($D_7$) connected to a point between said resistor and said condenser, a transistor ($T_5$) connected to said control circuit for controlling said first semi-conductor ($T_1$), and a connection from said Zener diode to said last named transistor.

2. System in accordance with claim 1, wherein each semiconductor consists of a transistor ($T_1$, $T_2$) whose collector is connected to its emitter through a Zener diode ($D_1$, $D_2$) and a conventional diode ($D_3$, $D_4$) which are connected in series.

3. Device in accordance with claim 1, wherein said electromagnet contains two windings ($B_1$, $B_2$), one of which receives the initial current and the other of which receives the maintenance current, and comprising a variable resistor ($R_v$) connected in the same line in series with the maintenance winding.

* * * * *